US005690462A

United States Patent [19]

Fan et al.

[11] Patent Number: 5,690,462

[45] Date of Patent: Nov. 25, 1997

[54] PARKING DEVICE FOR MOTOR VEHICLES

[76] Inventors: James Fan; Che Kao Chang, both of P.O. Box 82-144, Taipei, Taiwan

[21] Appl. No.: 714,202

[22] Filed: Sep. 16, 1996

[51] Int. Cl.[6] ..... B65G 1/10

[52] U.S. Cl. ..... 414/228; 414/234; 414/261; 187/207; 187/215

[58] Field of Search ..... 414/227, 228, 414/231, 232, 233, 234, 236, 240, 241, 244, 245, 246, 247, 252, 253, 261, 286; 254/2 R, 93 R; 187/210, 203, 213, 275, 206, 214, 215, 274, 207

[56] References Cited

U.S. PATENT DOCUMENTS

| | | | |
|---|---|---|---|
| 1,341,097 | 5/1920 | Young | 414/234 |
| 3,263,831 | 8/1966 | Francis | 414/234 |

FOREIGN PATENT DOCUMENTS

| | | | |
|---|---|---|---|
| 1417016 | 9/1965 | France | 414/228 |
| 55364 | 3/1991 | Japan | 414/234 |
| 55572 | 2/1992 | Japan | 414/228 |
| 272367 | 9/1992 | Japan | 414/228 |
| 59831 | 3/1993 | Japan | 414/228 |
| 133125 | 5/1993 | Japan | 414/228 |
| 139266 | 6/1993 | Japan | 414/228 |
| 179828 | 7/1993 | Japan | 414/227 |
| 57980 | 3/1994 | Japan | 414/227 |
| 358917 | 1/1962 | Switzerland | 187/207 |
| 1524962 | 9/1978 | United Kingdom | 187/215 |

*Primary Examiner*—Frank E. Werner
*Attorney, Agent, or Firm*—Alfred Lei

[57] ABSTRACT

A parking device including a base frame, a top frame, four cylindrical poles mounted between four corners of the base and top frames, each of the cylindrical poles having two tubular members slidably mounted thereon, an upper platform fixedly mounted on the tubular members at an upper position, a lower platform fixedly mounted on the tubular members at a lower position, a plurality of first hydraulic cylinders mounted on a bottom of the top frame and drivingly connected with the upper platform, a plurality of second hydraulic cylinders mounted mounted on the base frame and drivingly connected with the lower platform, and a positioning device having a casing mounted on each of the tubular members, solenoid fitted within the casing, a plunger fitted within the casing and a spring arranged between the solenoid and the plunger, the plunger being forced by the spring to go partly into a tube radially arranged within each of the poles through the tubular members.

2 Claims, 6 Drawing Sheets

PARKING DEVICE FOR MOTOR VEHICLES

BACKGROUND OF THE INVENTION

1. Field of the Invention

This invention relates to an improved parking device for motor vehicles.

2. Description of Prior Art

It has been found that the cost of land in a downtown area of a city is very expensive and so the land must be fully and reasonably utilized. Accordingly, it has become a serious problem for those who live or work in cities to find a place for parking a motor vehicle. Hence, a lot of mechanical parking devices have been proposed and developed to mitigate this problem. However, the commonly seen parking device on the market utilizes cables, chains, and pulleys to lower or lift a platform thereby making it difficult to keep steady in operation. Moreover, such a parking device is complicated in structure and unfit for practical use.

Therefore, it is an object of the present invention to provide an improved parking device which can obviate and mitigate the above-mentioned drawbacks.

SUMMARY OF THE INVENTION

This invention relates to an improved parking device for motor vehicles.

It is the primary object of the present invention to provide a parking device which can used for parking motor vehicles steadily and efficiently.

It is another object of the present invention to provide a parking device which is easy to operate and convenient for parking motor vehicles.

It is still another object of the present invention to provide a parking device which is of high security.

It is still another object of the present invention to provide a parking device which is sturdy in construction.

It is a further object of the present invention to provide a parking device which is facile to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
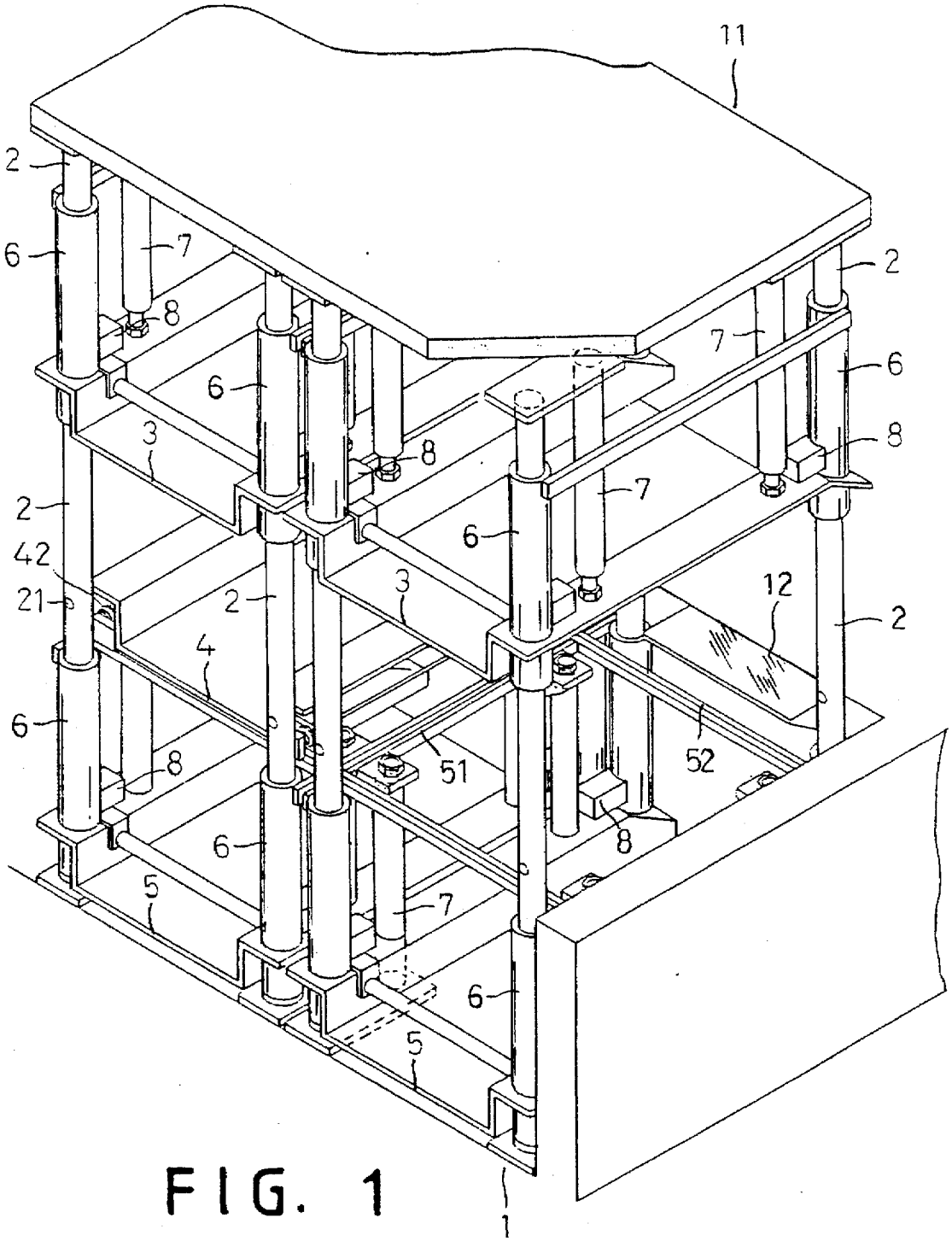
FIG. 1 is a perspective view of the present invention.

For the purpose of promoting an understanding of the principles of the invention, reference will now be made to the embodiment illustrated in the drawings. Specific language will be used to describe the same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, two sets of the parking device according to the present invention are installed adjacent to each other. As shown, each of the parking device comprises a base frame 1, a top frame 11, four cylindrical poles 2, eight tubular members 6, an upper platform 3, an intermediate platform 4, and a lower platform 5. The four cylindrical poles 2 are mounted between four corners of the base frame 1 and the top frame 11. Each of the cylindrical poles 2 has two tubular members 6 slidably mounted thereon. The upper platform 3 is fixedly mounted on the tubular members 6 at an upper position by known means. The lower platform 5 is fixedly mounted on the tubular members 6 at a lower position by appropriate known means. A rail assembly 51 is fixedly mounted on the four tubular members 6 by any suitable known means. The rail assembly 51 includes two transverse rails 52 on which is slidably mounted the intermediate platform 4. The intermediate platform 4 is located at the same height as an entrance 12. The lower side of the top frame 11 is provided with four hydraulic cylinders 7 which are drivingly connected with the upper platform 3 for controlling the elevation of the upper platform 3. Similarly, four hydraulic cylinders 7 are installed on the base frame 1 and drivingly connected to the lower platform 5 for controlling the elevation of the lower platform 5. The connection between the hydraulic cylinders 7 and the top frame 11, the base frame 1, the upper platform 3 and the lower platform 5 may be of any design well known to the art and need not be described here in detail.

Figure 2:
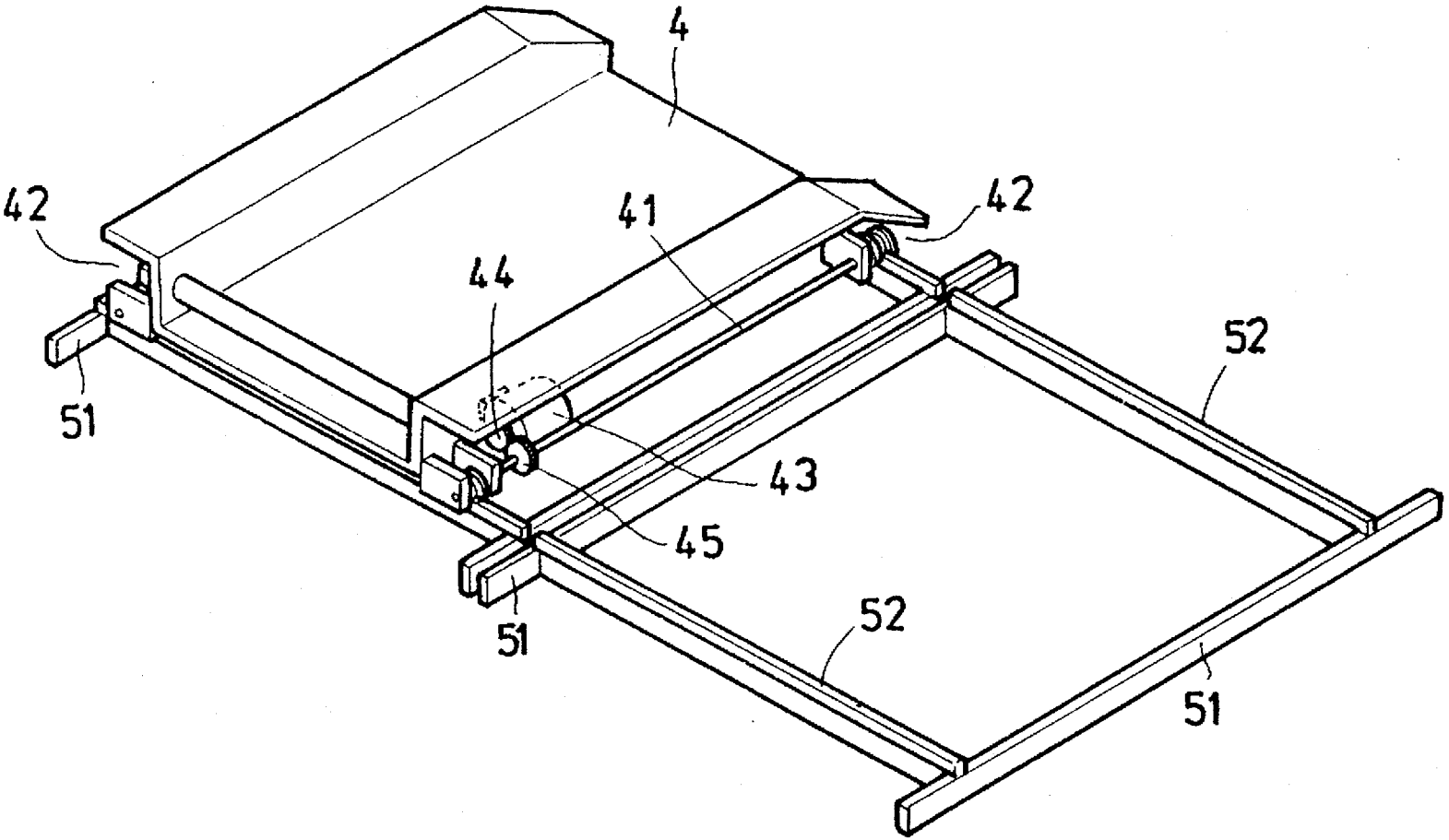
FIG. 2 illustrates the structure of the intermediate platform.

Referring to FIG. 2, the intermediate platform 4 is formed with two pairs of lugs at two opposite sides. Between two opposite pairs of lugs there is mounted a shaft 41 on which are arranged two rollers 42 at two opposite ends thereof. The rollers 42 are engaged with the two transverse rails. A driven gear 45 is mounted on the shaft 41 between the two rollers. An electric motor 43 is mounted at one side of the intermediate platform 4 and has an axle provided with a driving gear 44 which is meshed with the driven gear 45. Hence, when the electric motor 43 is turned on, the intermediate platform 4 will be moved along the transverse rails 52.

Figure 3:
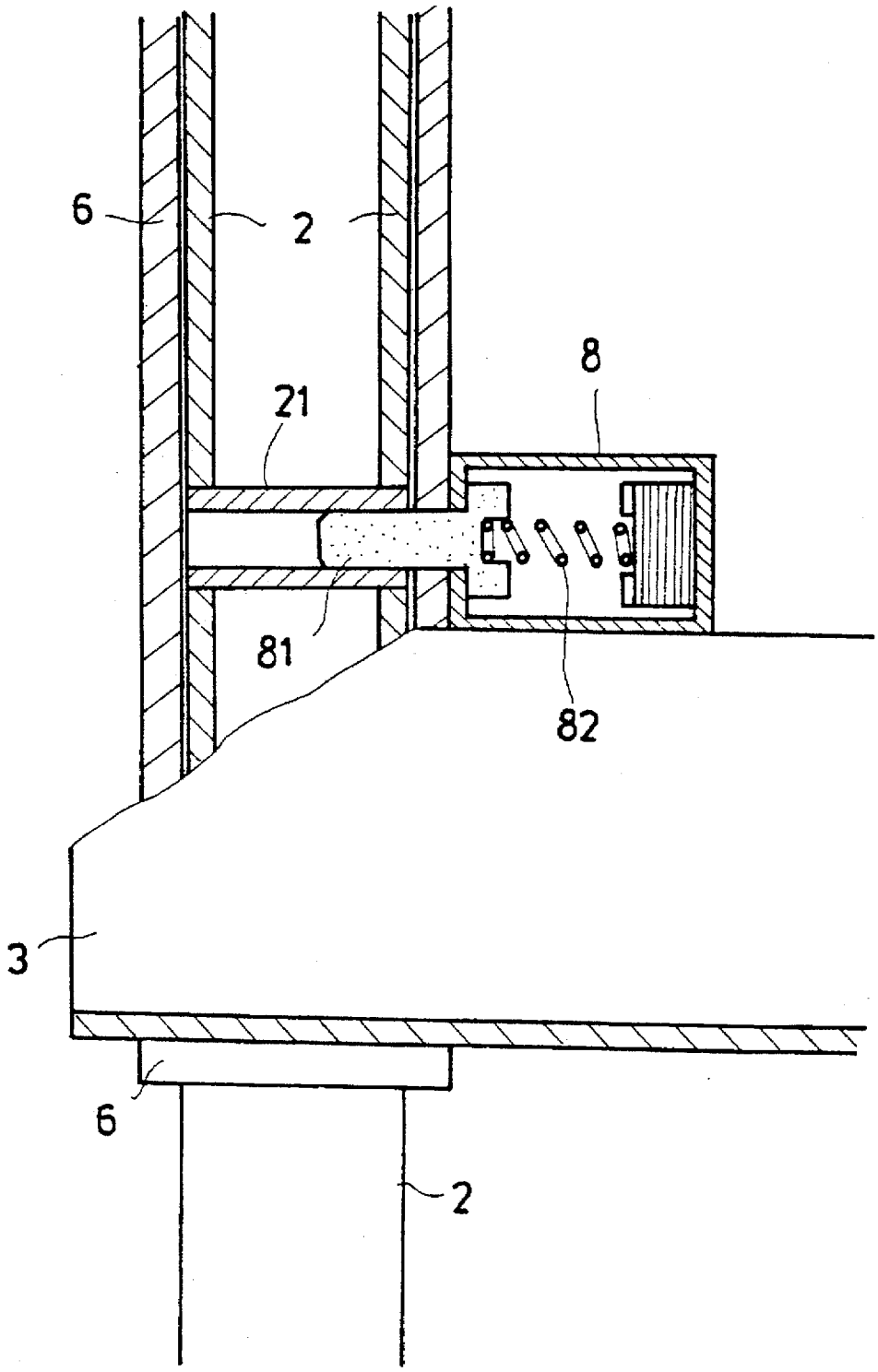
FIG. 3 illustrates the structure of the positioning means.
Figure 4:
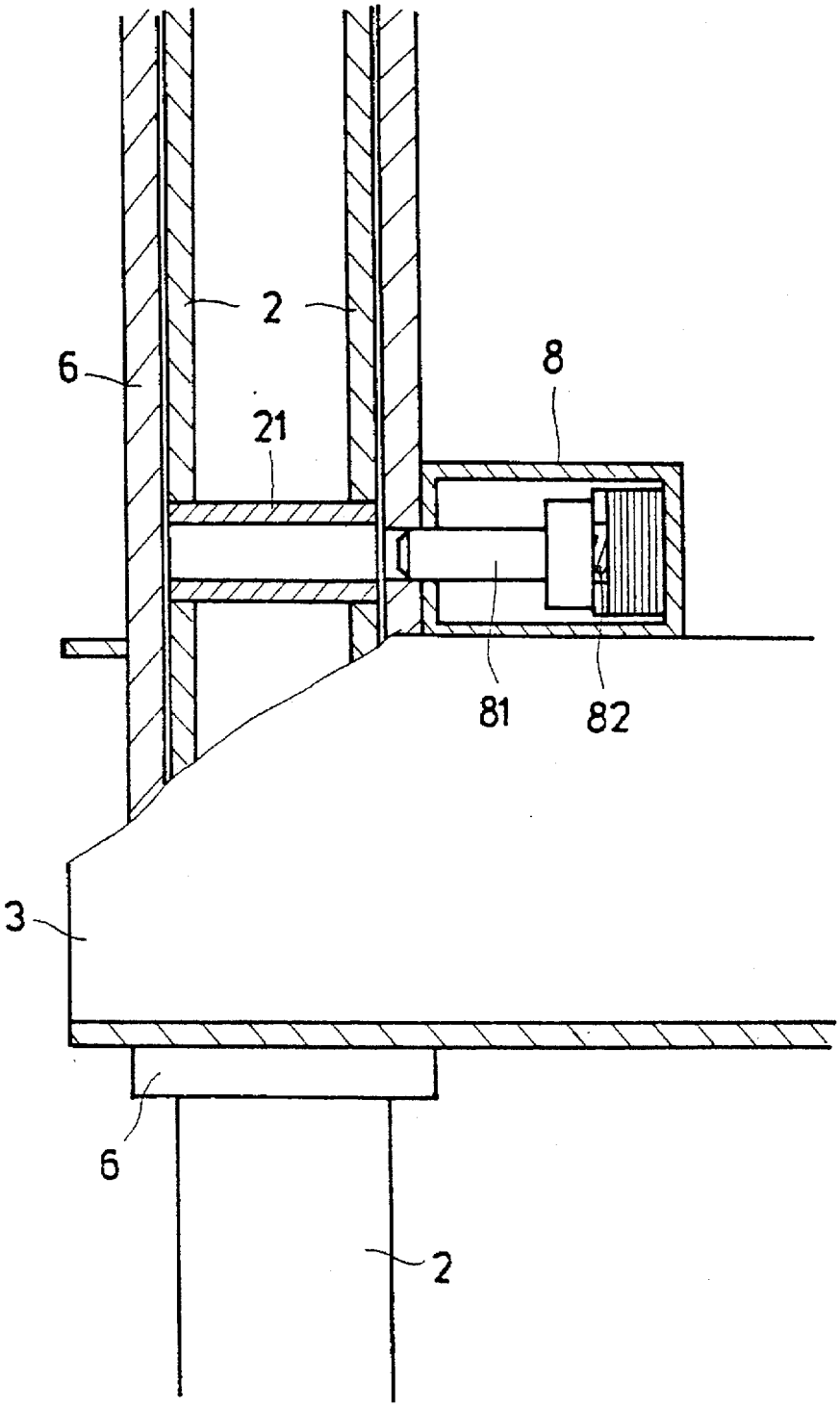
FIG. 4 illustrates how the positioning means works.

Referring to FIGS. 3 and 4, each of the tubular members 6 of the upper platform 3 and the lower platform 5 is provided with a positioning means 8. The positioning means 8 includes a casing in which are fitted a solenoid, a plunger 81 and a spring arranged between the solenoid and the plunger 81. The plunger 81 has an end extending out of the casing into a radial tube 21 installed within the tubular member 6. The solenoid is connected to a computerized controller (not shown) which can make the solenoid become a magnet by letting electric current flow therethrough. As there is an electric current flowing through the solenoid to make it become a magnet, the plunger 81 will be attracted to retract into the casing. When no current flows through the solenoid, the spring 82 will force the plunger 81 to go partly into a tube 21 radially fitted within the tubular member 6.

When desired to operate the upper platform 3 or the lower platform 5, it is only necessary to turn on the computerized controller so that an electric current will flow through the solenoid within the positioning means 8 thereby attracting the plunger 81 to go backward and then the hydraulic cylinders 7 will be actuated by the controller to move the upper platform 3 or the lower platform 5 to go up or down.

As the upper platform 3 or the lower platform 5 reaches its determined position, no current will flow through the solenoid thereby causing the spring 82 to move the plunger 81 partly into the tube 21 radially arranged within the tubular member 6 and therefore, keeping the upper platform 3 or the lower platform 5 at a determined position. The computerized controller and the technology for controlling the hydraulic cylinders 7 and the positioning means 8 may be of any design well known to those having ordinary skill in the art and are not considered a part of the invention.

Figure 5:
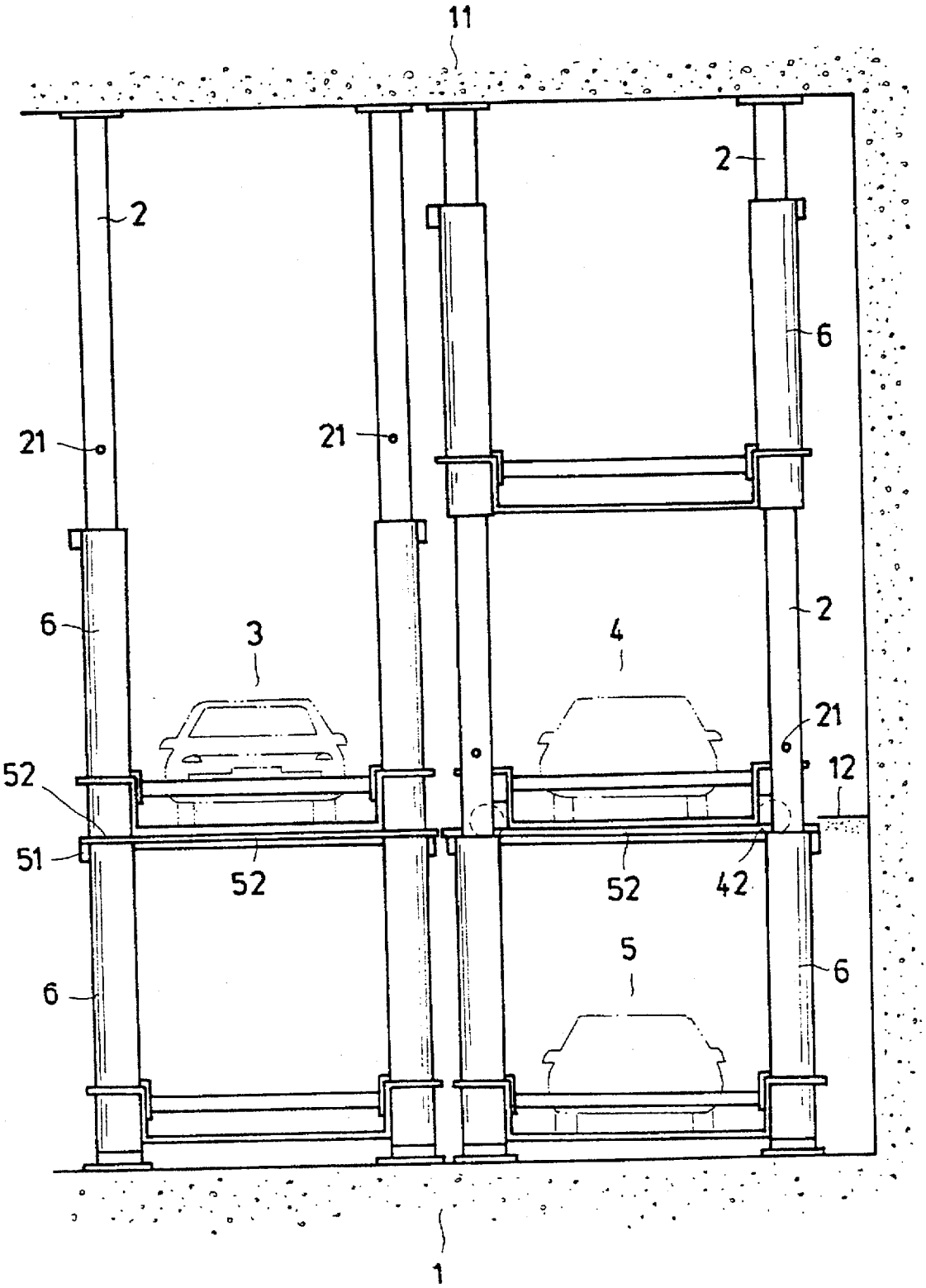
FIGS. 5 and 6 illustrate the working principle of the present invention.

Looking now at FIG. 5, two sets of the parking device according to the present invention are installed in adjacent position. The upper platform 3 and the lower platform 5 are designed so that they can be lifted to the the same height as the entrance 12. By means of the intermediate platform 4, the motor vehicle 4 can be easily moved in or out of the present invention.

Figure 6:
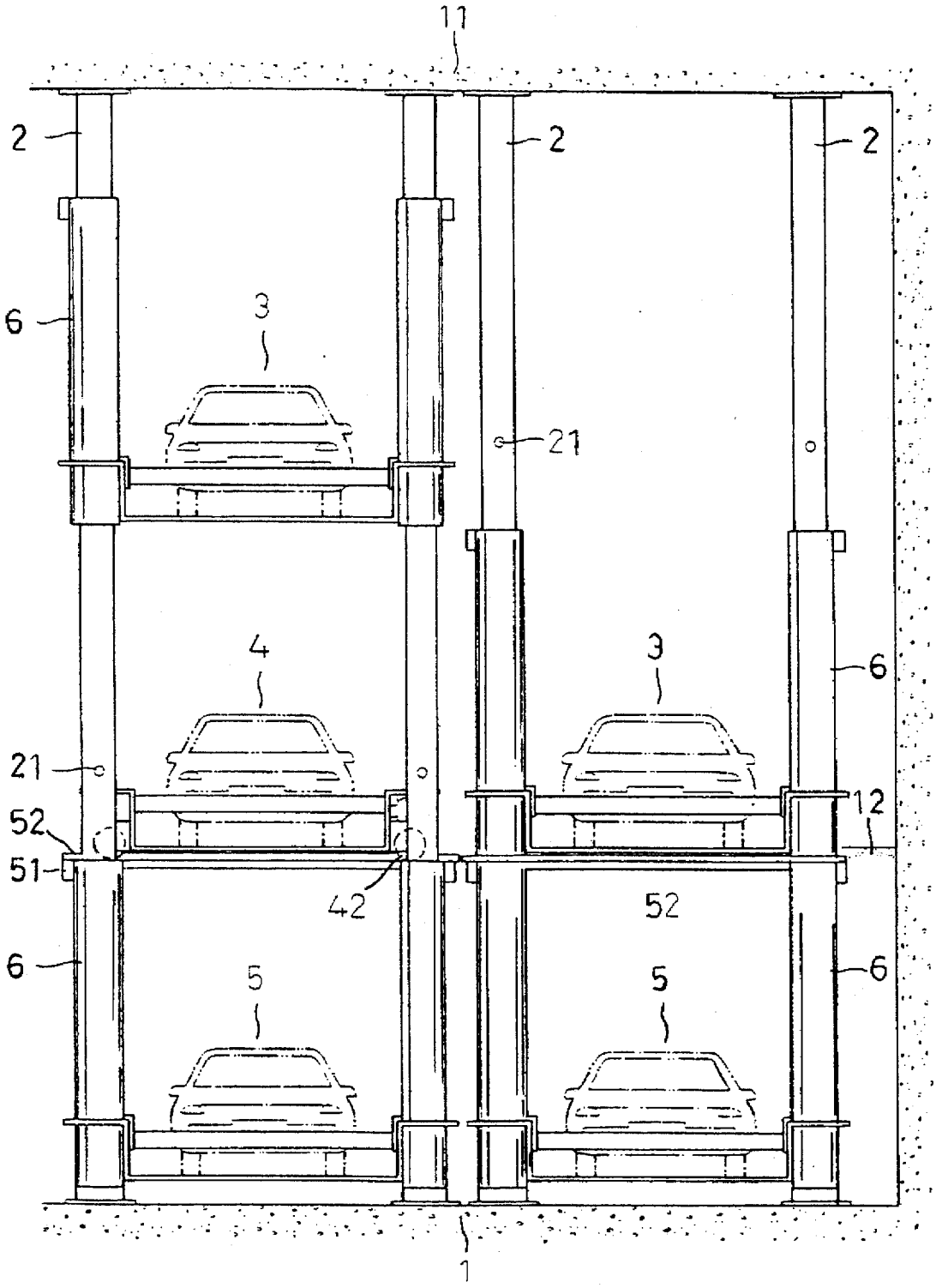

FIG. 6 illustrates the working principle of the present invention. As shown, when desired to take the car at the upper platform 3 of the left parking device (with respect to FIG. 6), the upper platform 3 at the right parking device (with respect to FIG. 6) is lifted to the uppermost position, the intermediate platform 4 is transversely moved to the right parking device and then the upper platform 3 at the left parking device is lowered down to the same height as the entrance 12 thereby enabling the car at the upper platform 3 of the left parking device to be driven out.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A parking device comprising:

a base frame;

a top frame;

four cylindrical poles mounted between four corners of said base frame and said top frame, each of said cylindrical poles having two tubular members slidably mounted thereon;

an upper platform fixedly mounted on said tubular members at an upper position;

a lower platform fixedly mounted on said tubular members at a lower position;

a plurality of first hydraulic cylinders mounted on a bottom of said top frame and drivingly connected with said upper platform;

a plurality of second hydraulic cylinders mounted on said base frame and drivingly connected with said lower platform; and positioning means having a casing mounted on each of said tubular members, a solenoid fitted within said casing, a plunger fitted within said casing and a spring arranged between said solenoid and said plunger, said plunger being forced by said spring to go partly into a tube radially arranged within each of said poles through said tubular members.

2. The parking device as claimed in claim 1, further comprising two rails mounted said tubular members and an intermediate platform slidably arranged on said rails, said intermediate platform including two pairs of lugs at two opposite sides thereof, a shaft mounted between two opposite pairs of said lugs and provided with two rollers at two opposite ends thereof, a driven gear installed on said shaft between said rollers, an electric motor mounted at one side of said intermediate platform and having an axle provided with a driving gear meshed with said driven gear.

* * * * *